US005694006A

United States Patent [19]

Konopka

[11] Patent Number: 5,694,006

[45] Date of Patent: Dec. 2, 1997

[54] SINGLE SWITCH BALLAST WITH INTEGRATED POWER FACTOR CORRECTION

[75] Inventor: John G. Konopka, Barrington, Ill.

[73] Assignee: Motorola, Inc., Schaumburg, Ill.

[21] Appl. No.: 627,559

[22] Filed: Apr. 4, 1996

[51] Int. Cl.[6] ..... H05B 37/02

[52] U.S. Cl. ..... 315/219; 315/247; 315/307; 315/224; 315/DIG. 7; 315/DIG. 5; 315/DIG. 4

[58] Field of Search ..... 315/219, 247, 315/307, 244, DIG. 4, 224, DIG. 7, DIG. 5; 363/18, 15

[56] References Cited

U.S. PATENT DOCUMENTS

| | | | |
|---|---|---|---|
| 2,994,012 | 7/1961 | Negrete | 315/219 |
| 3,922,582 | 11/1975 | Pitel | 315/106 |
| 4,072,878 | 2/1978 | Engel et al. | 315/205 |
| 4,081,718 | 3/1978 | Kaneda | 315/244 |
| 4,194,143 | 3/1980 | Farkas et al. | 315/241 R |
| 4,254,362 | 3/1981 | Tulleners | 315/219 |
| 4,257,088 | 3/1981 | Nilssen | 363/18 |
| 5,144,204 | 9/1992 | Nerone et al. | 315/209 R |
| 5,367,224 | 11/1994 | Pacholok | 315/219 |

*Primary Examiner*—Robert Pascal
*Assistant Examiner*—Michael Shingleton
*Attorney, Agent, or Firm*—Gary J. Cunningham; Kenneth L. Labudda

[57] ABSTRACT

An electronic ballast (200) includes a rectifier circuit (20), an energy storage inductor (38), a power switch (58), a control circuit (50) for driving the power switch (58), a clamp diode (46), a voltage clamping capacitor (54), a bulk capacitor (34), and an output circuit (70) for providing power to one or more fluorescent lamps (100). In a preferred embodiment, the rectifier circuit (20) includes a full-wave diode bridge (22) and a high frequency filter capacitor (24), and the output circuit (70) has a resonant inductor (72), a resonant capacitor (82), and a dc blocking capacitor (88). The ballast (200) provides power factor correction and high frequency power for fluorescent lamps, but requires only a single power switch (58) and a single energy storage inductor (38).

19 Claims, 3 Drawing Sheets

SWITCH OPEN

SWITCH CLOSED

SINGLE SWITCH BALLAST WITH INTEGRATED POWER FACTOR CORRECTION

FIELD OF THE INVENTION

The present invention relates to the general subject of ballasts and, in particular, to a single switch ballast having integrated power factor correction.

BACKGROUND OF THE INVENTION

Traditional magnetic coil ballasts possess many operational disadvantages, such as poor energy efficiency and high flicker. Electronic ballasts overcome the shortcomings of magnetic ballasts, but at a considerably higher monetary cost.

A common type of electronic ballast includes a rectifier circuit, a DC to DC switching converter for providing power factor correction, a high frequency inverter, and an output circuit. Such a ballast typically requires three or more power transistor switches, in addition to a large number of other components, of which magnetic components such as inductors and transformers are typically the most costly and the most difficult to manufacture. Due to its complexity and high component count, the resulting ballast is expensive and therefore not competitive with relatively low cost magnetic ballasts.

Recently, efforts have been made to devise electronic ballast circuits which rival the low monetary cost of magnetic ballasts, but without sacrificing key performance advantages such as high energy efficiency, negligible flicker, high power factor, and low harmonic distortion.

Toward this end, U.S. Pat. No. 5,399,944 discloses a novel electronic ballast circuit which achieves a substantial reduction in component count and product cost by combining the functionality of a power factor correction converter and a high frequency inverter into a single converter stage that requires only one power transistor switch. The single converter stage includes two separate magnetic components, one of which is an inductor that is dedicated to power factor correction and the other of which serves as a "clamp" inductor for limiting the peak voltage across the transistor switch. Since magnetic components are among the largest and most expensive components used in electronic ballasts, and thus detract greatly from the goals of low material and manufacturing cost, significant impetus exists for developing new ballast circuits in which the number of magnetic components is reduced or minimized.

It is therefore apparent that an electronic ballast which requires a minimal number of magnetic components, with a reduced physical size and lower material and manufacturing costs, but does so without sacrificing important advantages such as high power factor and low harmonic distortion in the ac line current, would constitute a significant improvement over the prior art.

DETAILED DESCRIPTION OF A PREFERRED EMBODIMENT

Figure 1:
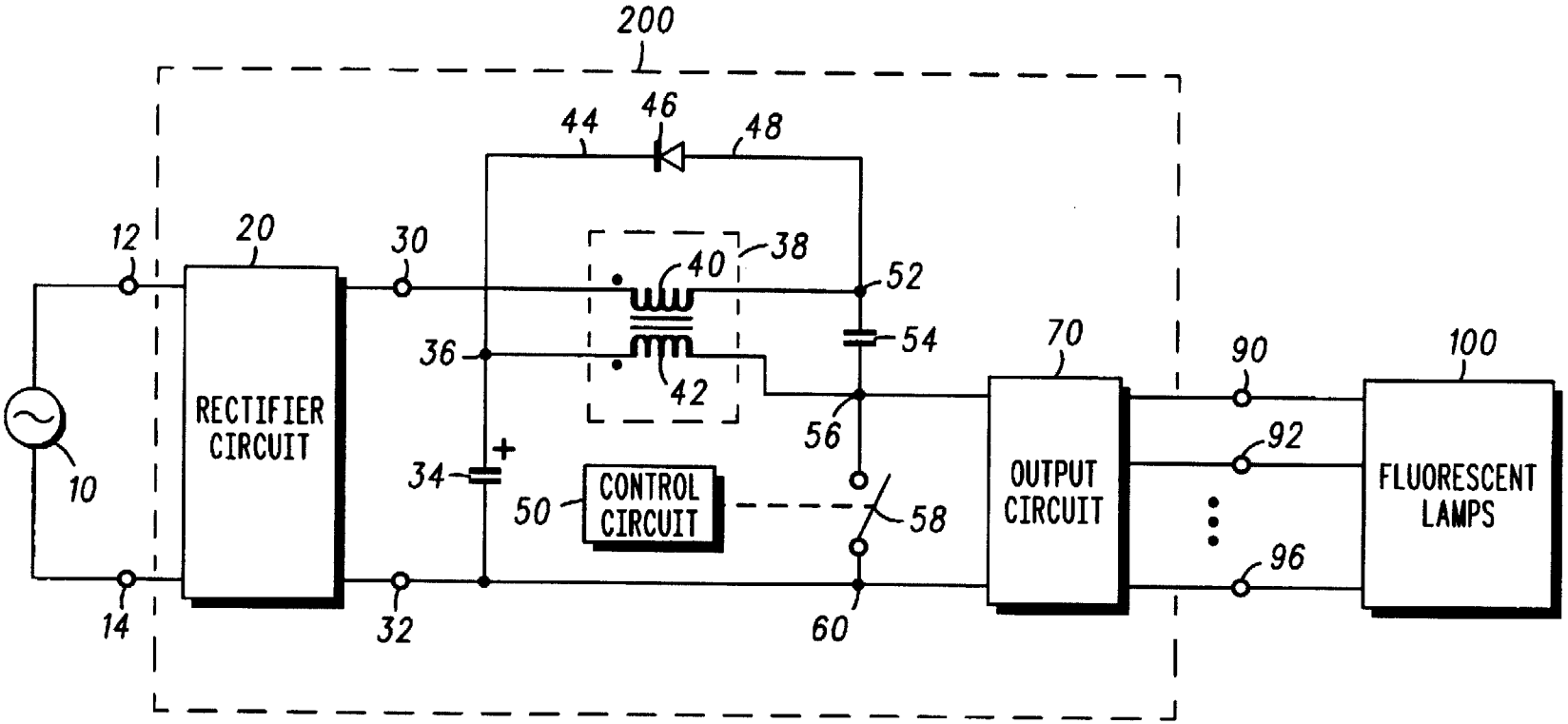
FIG. 1 describes an electronic ballast that includes a single power switch and a single energy storage inductor, in accordance with the present invention.

FIG. 1 shows an electronic ballast 200 for driving a fluorescent lamp load 100 consisting of one or more fluorescent lamps. The ballast 200 includes a rectifier circuit 20, an energy storage inductor 38, a power switch 58, a control circuit 50 for driving the power switch 58, a voltage clamping capacitor 54, a clamp diode 46 having an anode terminal 48 and a cathode terminal 44, a bulk capacitor 34, and an output circuit 70.

The rectifier circuit 20 has a pair of input terminals 12, 14 for receiving an alternating current (ac) source 10, and a pair of output terminals 30, 32. The energy storage inductor 38 includes a primary winding 40 that is coupled between a first output terminal 30 of rectifier circuit 20 and a first node 52, and a secondary winding 42 that is coupled between a second node 56 and a third node 36. The power switch 58 is coupled between the second node 56 and a fourth node 60, while the fourth node 60 is coupled to a second output terminal 32 of rectifier circuit 20. The anode terminal 48 of clamp diode 46 is coupled to the first node 52, and the cathode terminal 44 is coupled to the third node 36. Bulk capacitor 34 is coupled between the third node 36 and the fourth node 60. Finally, the output circuit 70 is coupled across the second node 56 and the fourth node 60, and includes two or more output wires 90, 92, 96 that are adapted for connection to a fluorescent lamp load 100 consisting of one or more fluorescent lamps.

Ballast 200 supplies a high frequency alternating current to fluorescent lamp load 100 and provides for power factor correction, but requires only a single power switch 58 and a single energy storage inductor 38. Ballast 200 thus offers considerable advantages with regard to component count, physical size, and costs of material and manufacturing.

In a practical implementation of ballast 200, power switch 58 includes at least one of any of a number of controllable devices which are suited for high power switching, examples of which are a field-effect transistor (FET) and a bipolar junction transistor (BJT). The actual choice of which type of device to use for power switch 58 is dictated by a number of design considerations, such as the voltage and current experienced by the power switch 58, characteristics of the drive signal provided by control circuit 50, as well as the material cost of the devices themselves.

Figure 2:
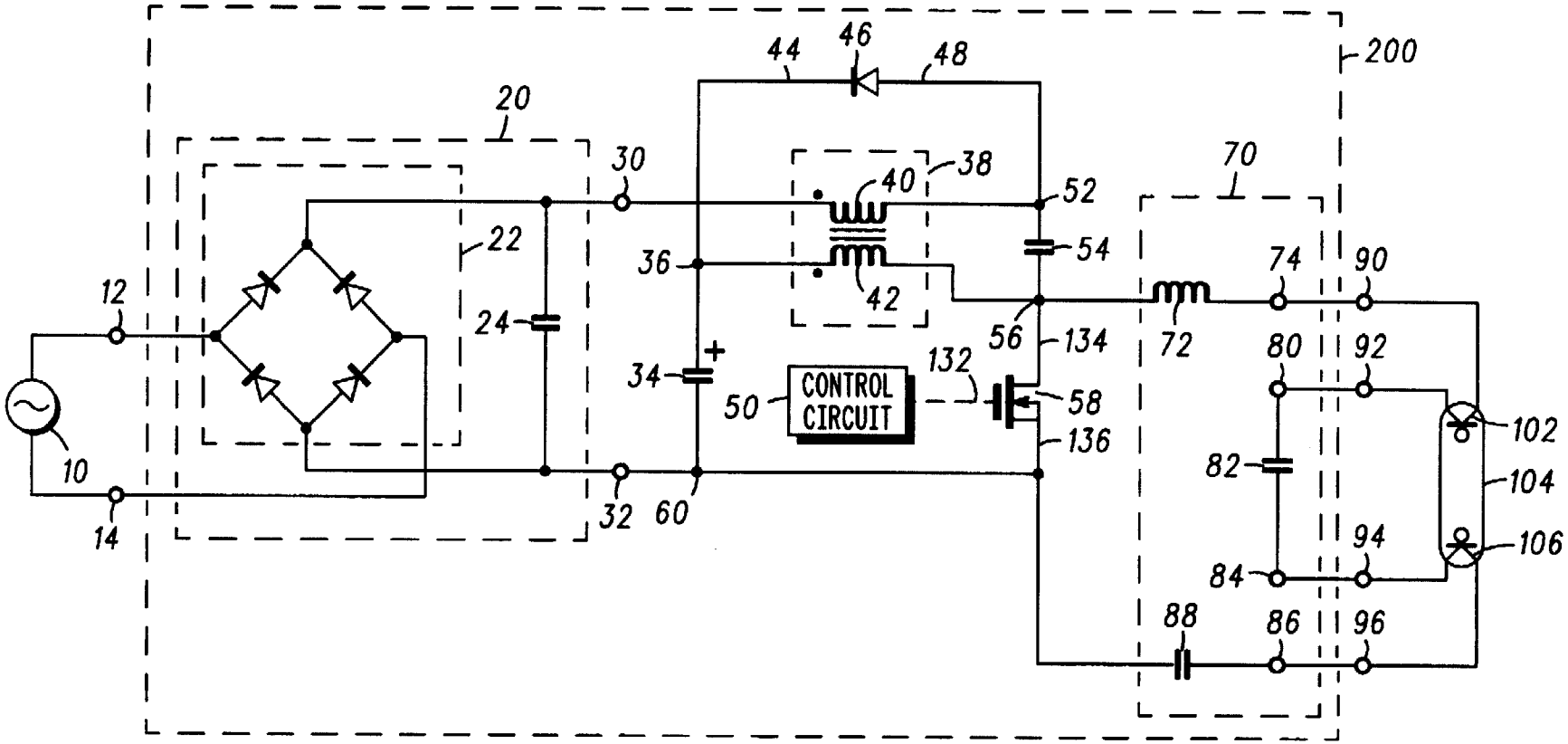
FIG. 2 is a schematic of a preferred embodiment of an electronic ballast circuit, in accordance with the present invention.

A preferred embodiment of ballast 200 is shown in FIG. 2. The rectifier circuit 20 includes a full-wave diode bridge 22 and a high frequency filter capacitor 24 that is coupled across the output terminals 30, 32 of rectifier circuit 20. The function of high frequency filter capacitor 24 is to supply a demand for high frequency current which arises from operation of power switch 58 at a high frequency rate that is typically in excess of 20,000 Hertz. In the absence of capacitor 24, the high frequency current would have to be supplied directly from the ac source 10, the undesirable end results of which would include lower power factor and larger total harmonic distortion. In a preferred embodiment, power switch 58 comprises a field-effect transistor having a gate terminal 132, a drain terminal 134, and a source terminal 136. The drain terminal 134 is coupled to the second node 56, the source terminal 136 is coupled to the fourth node 60, and the gate terminal 132 is adapted to receive a drive signal supplied by control circuit 50. Control circuit 50 includes a pulse-width modulator for driving the power switch 58 at a high frequency rate, and with a variable duty cycle, so as to provide both power factor correction and high frequency power to one or more fluorescent lamps 100 by way of output circuit 70.

Referring again to FIG. 2, the primary winding 40 and secondary winding 42 of energy storage inductor 38 are oriented in relation to each other such that the presence of a positive voltage across the secondary winding 42 from the third node 36 to the second node 56 coincides with the presence of a positive voltage across the primary winding 40 from the first output terminal 30 of rectifier circuit 20 to the first node 52. In order to minimize power dissipation in energy storage inductor 38, it is preferred that primary winding 40 and secondary winding 42 have an equal number of turns.

In one embodiment, the output circuit 70 includes a series resonant circuit including a resonant inductor 72 and a resonant capacitor 82, and a direct current (dc) blocking capacitor 88. Specifically, resonant inductor 72 is coupled between the second node 56 and a fifth node 74, resonant capacitor 82 is coupled between a sixth node 80 and a seventh node 84, and dc blocking capacitor 88 is coupled between an eighth node 86 and the fourth node 60. The function of capacitor 88 is to block the dc component of the voltage supplied to output circuit 70 between node 56 and node 60, so that the series combination of resonant inductor 72 and resonant capacitor 82 sees (i.e., between nodes 56 and node 84) a substantially symmetrical squarewave voltage having essentially no direct current (dc) component, thereby allowing a substantially sinusoidal ac current to be supplied to the lamp 100.

In a preferred embodiment, as illustrated in FIG. 2, the fifth node 74 and the sixth node 80 are coupled together through a first filament 102 of a fluorescent lamp 104, while the seventh node 84 and the eight node 86 are coupled together through a second filament 106 of fluorescent lamp 104. As long as the first filament 102 and second filament 106 are intact and connected to their respective output wires 90, 92, 94, 96, output circuit 70 will operate since a path exists for an alternating (ac) current to flow through resonant inductor 72, first filament 102, resonant capacitor 82, second filament 106, and dc blocking capacitor 88. At the same time, the flow of an ac current through the filaments 102, 106 provides the filaments with heating current required for rapid-start operation. Output circuit 70 ceases to operate when lamp 104 is removed, or when either one or both of the lamp filaments 102, 106 are not intact or are not connected to their respective output wires 90, 92, 94, 96. Such a coupling scheme thus provides the desirable feature of automatic shutdown of the output circuit 70 in the event of an open filament or lamp removal.

Figure 3A:
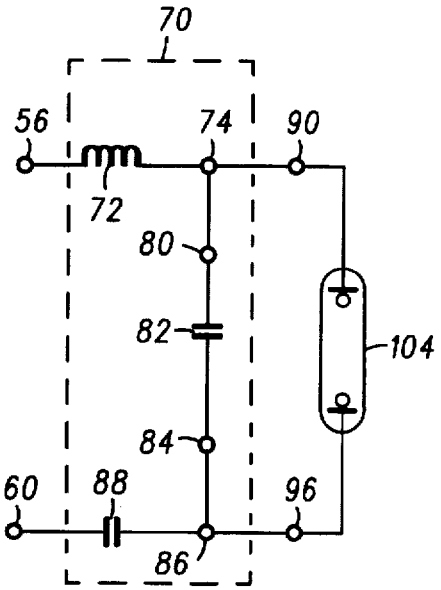
FIGS. 3A and 3B are diagrams of alternative output circuits, in accordance with the present invention.

An alternative lamp coupling scheme that is suitable for applications involving instant-start lamps is shown in FIG. 3A. Here, the fifth node 74 and sixth node 80, as well as the seventh node 84 and eighth node 86, are connected to each other, and a fluorescent lamp 104 is coupled between the fifth node 74 and the eight node 86.

Figure 3B:
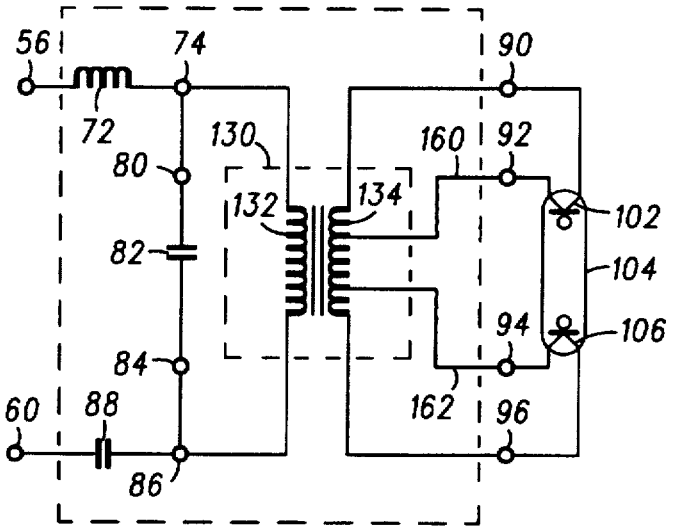

FIG. 3B describes an alternative lamp coupling scheme for rapid-start applications which uses an output transformer 130 to provide electrical isolation between the output wires 90, 92, 94, 96 and ac source 10. The output transformer 130 includes a primary winding 132 that is coupled between the fifth node 74 and the eighth node 86, and at least one secondary winding 134. Secondary winding 134 may include tap connections 160,162 for providing a heating voltage across each of the lamp filaments 102, 106. Although the embodiment shown in FIG. 2 shows only a single lamp 104, multiple lamps can be accommodated by including additional secondary windings for filament heating.

Figure 4A:
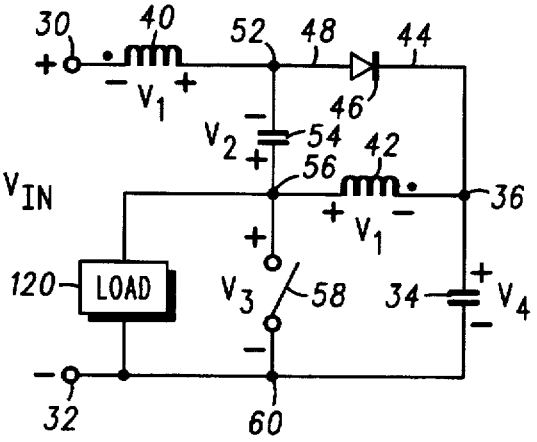
FIGS. 4A and 4B are equivalent circuit diagrams of a portion of the electronic ballast of FIG. 2 for periods in which-the power switch is open and closed, in accordance with the present invention.
Figure 4B:
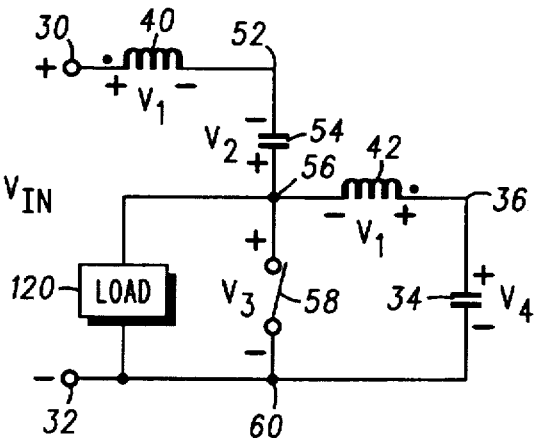

Turning now to FIGS. 4A and 4B, the operation of the ballast 200 of FIG. 2 is described as follows. In order to minimize the amount of low frequency (e.g. 120 Hertz) "ripple" present in the predominantly high frequency current supplied to the load 120, it is preferred that bulk capacitor 34 be chosen to have a relatively large capacitance value, usually on the order of tens of microfarads. Consequently, the voltage $V_4$ across bulk capacitor 34 maintains a predominantly dc value, the magnitude of which is dependent upon a number of factors, including the voltage of ac source 10, the duty cycle range over which power switch 58 is operated, and the load 120 presented by the combination of output circuit 70 and fluorescent lamp load 100.

Referring to FIGS. 4A and 4B, the voltage $V_2$ across voltage clamping capacitor 54 is the same regardless of whether switch 58 is on or off, and is equal to the difference between the voltage $V_4$ across bulk capacitor 34 and the rectified ac voltage $V_{in}$ present between node 30 and node 32. It follows that the voltage $V_2$ tracks the voltage of ac source 10 in a negative fashion, so that $V_2$ is maximum when the voltage of ac source 10 is minimum, and vice versa.

Referring now to FIG. 4A in particular, during those periods of time in which switch 58 is on, a charging current flows from the first rectifier circuit output terminal 30 through primary winding 40, capacitor 54, switch 58, and back to the second rectifier circuit output terminal 32. As the voltage $V_1$ across primary winding 40 is essentially constant during the period being considered, the charging current increases in a substantially linear fashion, causing an increasing amount of energy to be stored in primary winding 40. At the same time, with switch 58 on, the voltage supplied to load 120, which includes both the output circuit 70 and the fluorescent lamp load 100 identified in FIG. 1, is equal to zero. In addition, a substantially linearly increasing positive current flows through secondary winding 42 from node 36 to node 56, so that energy is transferred from bulk capacitor 34 to secondary winding 42. Diode 46 is not shown in FIG. 4B since it is reverse-biased, and therefore remains non-conductive, during the entire period of time in which switch 58 is closed.

Once switch 58 is turned off, the current flowing through secondary winding 42 begins to decrease rapidly. Consequently, the voltage $V_1$ across secondary winding 42 reverses polarity and attempts to rise to an extremely high level. However, before $V_1$ can rise to an extremely high level diode 46 becomes forward biased and turns on when the voltage at node 52 attempts to exceed the voltage $V_4$ across bulk capacitor 34. Equivalently, the clamping action of diode 46 limits the voltage $V_1$ across secondary winding 42 to $(V_4-V_{in})$, and limits the voltage $V_3$ across the switch 58 to $(2V_4-V_{in})$. With diode 46 now on, the energy stored in the primary winding 40 is transferred into bulk capacitor 34 and the current flowing through primary winding 40 begins to decrease in a substantially linear fashion. With switch 58 open, energy is supplied to load 120 by secondary winding 42 and bulk capacitor 34.

As can be gathered from the foregoing, with regard to the substantially linearly increasing and decreasing current which flows through primary winding 40, and from the point of view of ac source 10, the ballast 200 behaves in a manner somewhat similar to that of a conventional boost converter circuit which is well known and widely used in the prior art for purposes of power factor correction. In addition, as the voltage $V_3$ across switch 58 periodically varies between zero and a dc level substantially equal to $(2V_4-V_{in})$, the ballast 200 provides a substantially squarewave voltage $V_3$ to output circuit 70 that is equivalent to that provided by much more complicated prior art circuits, such as a half bridge inverter. The proposed ballast 200 therefore requires only a single power switch 58 and a single energy storage inductor 38 to provide both power factor correction and an inverter output voltage that is suitable for driving a fluorescent lamp load 100 via an output circuit 70.

In a prototype ballast configured substantially as shown in FIG. 2, a power factor of 0.986, a total harmonic distortion of 12%, and a third harmonic distortion of 6.9% were measured. The lamp current crest factor, which is a measure of the amount of undesirable low frequency (120 Hertz) ripple that is present in the predominantly high frequency (e.g. in excess of 20,000 Hertz) current supplied to the lamp 104, was measured as 1.48, which satisfies accepted ballast performance standards for lamp current quality. The disclosed ballast 200 thus provides power factor correction and an appropriate quality of high frequency current to fluorescent lamps, yet requires less circuitry than prior art approaches.

The primary advantage of the disclosed ballast circuit 200 is its use of a single power switch 58 in conjunction with an energy storage inductor 38 such that only a single magnetic component is required in order to achieve the functionality of both a power factor correction circuit and an inverter. This results in an electronic ballast 200 having, in comparison with existing approaches, a smaller physical size, lower component count, reduced material cost, and greater ease of manufacture.

Although the present invention has been described with reference to a certain preferred embodiment, numerous modifications and variations can be made by those skilled in the art without departing from the novel spirit and scope of this invention.

What is claimed is:

1. An electronic ballast comprising:

a rectifier circuit having a pair of input terminals and a pair of output terminals, the input terminals being adapted to receive a source of alternating current;

an energy storage inductor having a primary winding and a secondary winding, the primary winding being coupled between a first output terminal of the rectifier circuit and a first node, the secondary winding being coupled between a second node and a third node;

a power switch coupled between the second node and a fourth node, the fourth node being coupled to a second output terminal of the rectifier circuit;

a control circuit for driving the power switch;

a voltage clamping capacitor coupled between the first node and the second node;

a clamp diode having an anode terminal and a cathode terminal, the anode terminal being coupled to the first node and the cathode terminal being coupled to the third node;

a bulk capacitor coupled between the third node and the fourth node; and an output circuit coupled between the second node and the fourth node, the output circuit including at least two output wires adapted to be coupled to at least one fluorescent lamp.

2. The electronic ballast of claim 1, wherein the rectifier circuit comprises a full-wave diode bridge.

3. The electronic ballast of claim 1, wherein the rectifier circuit includes a high frequency filter capacitor coupled across the rectifier circuit output terminals.

4. The electronic ballast of claim 1, wherein the power switch comprises at least one of a field-effect transistor and a bipolar junction transistor.

5. The electronic ballast of claim 1, wherein the control circuit includes a pulse-width modulator for driving the power switch at a variable duty cycle.

6. The electronic ballast of claim 1, wherein the primary and secondary windings of the energy storage inductor are oriented in relation to each other such that the presence of a positive voltage across the secondary winding from the third node to the second node coincides with the presence of a positive voltage across the primary from the first output terminal of the rectifier circuit to the first node.

7. The electronic ballast of claim 1, wherein the output circuit comprises a resonant inductor, a resonant capacitor, and a dc blocking capacitor.

8. The electronic ballast of claim 7, wherein the resonant inductor is coupled between the second node and a fifth node, the resonant capacitor is coupled between a sixth node and a seventh node, and a dc blocking capacitor is coupled between an eighth node and the fourth node.

9. The electronic ballast of claim 8, wherein the fifth node is connected to the sixth node, the seventh node is connected to the eighth node, and the fifth node and the eighth node are adapted to having at least one fluorescent lamp coupled between them.

10. The electronic ballast of claim 8, wherein the fifth node is adapted to being coupled to the sixth node through a first filament of a fluorescent lamp, and the seventh node is adapted to being coupled to the eighth node through a second filament of the fluorescent lamp.

11. The electronic ballast of claim 8, further comprising an output transformer having a primary winding and at least one secondary winding, wherein the fifth node is connected to the sixth node, the seventh node is connected to the eighth node, the primary winding of the output transformer is coupled between the fifth node and the eight node, and at least one secondary winding of the output transformer is adapted to being coupled to at least one fluorescent lamp.

12. An electronic ballast comprising:

a rectifier circuit having a pair of input terminals and a pair of output terminals, the input terminals being adapted to receive a source of alternating current;

an energy storage inductor having a primary winding and a secondary winding, the primary winding being coupled between a first output terminal of the rectifier circuit and a first node, the secondary winding being coupled between a second node and a third node, the primary and secondary windings being oriented in relation to each other such that the presence of a positive voltage across the secondary winding from the third node to the second node coincides with the presence of a positive voltage across the primary from the first output terminal of the rectifier circuit to the first node;

a power switch coupled between the second node and a fourth node, the fourth node being coupled to a second output terminal of the rectifier circuit;

a voltage clamping capacitor coupled between the first node and the second node;

a clamp diode having an anode terminal and a cathode terminal, the anode terminal being coupled to the first node and the cathode terminal being coupled to the third node;

a bulk capacitor coupled between the third node and the fourth node;

a control circuit for driving the power switch; and an output circuit coupled between the second node and the fourth node, the output circuit comprising a resonant inductor coupled between the second node and a fifth node, a resonant capacitor coupled between a sixth node and a seventh node, and a dc blocking capacitor coupled between an eighth node and the fourth node, the output circuit including at least two output wires adapted to be coupled to at least one fluorescent lamp.

13. The electronic ballast of claim 12, wherein the rectifier circuit comprises a full-wave diode bridge and a high frequency filter capacitor, the high frequency filter capacitor being coupled across the output terminals of the rectifier circuit.

14. The electronic ballast of claim 12, wherein the power switch comprises at least one of a field-effect transistor and a bipolar junction transistor.

15. The electronic ballast of claim 12, wherein the control circuit includes a pulse-width modulator for driving the power switch at a variable duty cycle.

16. The electronic ballast of claim 12, wherein the fifth node is connected to the sixth node, the seventh node is connected to the eighth node, and the fifth node and the eighth node are adapted to having at least one fluorescent lamp coupled between them.

17. The electronic ballast of claim 12, wherein the fifth node is adapted to being coupled to the sixth node through a first filament of a fluorescent lamp, and the seventh node is adapted to being coupled to the eighth node through a second filament of the fluorescent lamp.

18. The electronic ballast of claim 12, further comprising an output transformer having a primary winding and at least one secondary winding, wherein the fifth node is connected to the sixth node, the seventh node is connected to the eighth node, the primary winding of the output transformer is coupled between the fifth node and the eight node, and at least one secondary winding of the output transformer is adapted to being coupled to at least one fluorescent lamp.

19. An electronic ballast comprising:

a rectifier circuit having a pair of input terminals and a pair of output terminals, the input terminals being adapted to receive a source of alternating current, the rectifier circuit comprising a full-wave diode bridge and a high frequency filter capacitor, the high frequency filter capacitor being coupled across the rectifier circuit output terminals;

an energy storage inductor having a primary winding and a secondary winding, the primary winding being coupled between a first output terminal of the rectifier circuit and a first node, the secondary winding being coupled between a second node and a third node, the primary and secondary windings being oriented in relation to each other such that the presence of a positive voltage across the secondary winding from the third node to the second node coincides with a positive voltage across the primary from the first output terminal of the rectifier circuit to the first node;

a field-effect transistor having a gate terminal, a drain terminal, and a source terminal, the drain terminal being coupled to the second node, the source terminal being coupled to the fourth node, the fourth node being coupled to a second output terminal of the rectifier circuit, and the gate terminal being adapted to receive a drive signal for rendering the transistor conductive and non-conductive from the drain terminal to the source terminal;

a voltage clamping capacitor coupled between the first node and the second node;

a clamp diode having an anode terminal and a cathode terminal, the anode terminal being coupled to the first node and the cathode terminal being coupled to the third node;

a bulk capacitor coupled between the third node and the fourth node;

a control circuit including a pulse-width modulator for driving the field-effect transistor at a variable duty cycle; and an output circuit coupled between the second node and the fourth node, the output circuit comprising a resonant inductor coupled between the second node and a fifth node, a resonant capacitor coupled between a sixth node and a seventh node, and a dc blocking capacitor coupled between an eighth node and the fourth node, wherein the fifth node is adapted to being coupled to the sixth node through a first filament of a fluorescent lamp, and the seventh node is adapted to being coupled to the eight node through a second filament of the fluorescent lamp.

* * * * *